United States Patent [19]

Imbert

[11] Patent Number: 4,690,467

[45] Date of Patent: Sep. 1, 1987

[54] SECURITY ENCLOSURE HAVING ONE OR MORE COMPARTMENTS FOR HOUSING AND PROTECTING A WINDSURFER AGAINST THEFT

[76] Inventor: Louis Imbert, 3, rue Alphonse Daudet, Trebes, France, 11800

[21] Appl. No.: 447,621

[22] Filed: Dec. 7, 1982

[30] Foreign Application Priority Data

Dec. 9, 1981 [FR] France ..... 81 23334

[51] Int. Cl.[4] ..... A47B 81/00; A47B 53/00

[52] U.S. Cl. ..... 312/198; 70/58; 211/60.1; 211/70.5; 232/1 D; 232/9; 312/229

[58] Field of Search ..... 312/198, 207, 229, 0–1, 312/59, 999; 70/58, 62, DIG. 41, 4; 211/60 SK, 191, 60.1; 232/38, 14, 9, 12, 15, 16, 1 D

[56] References Cited

U.S. PATENT DOCUMENTS

| | | | |
|---|---|---|---|
| 220,661 | 10/1879 | Robbins | 232/9 |
| 477,758 | 6/1892 | Huss | 312/229 |
| 477,917 | 6/1892 | Strater | 312/229 X |
| 499,449 | 6/1893 | Bronner | 312/229 X |
| 791,997 | 6/1905 | Bagby | 312/229 X |
| 912,168 | 2/1909 | Reese | 312/229 X |
| 1,013,991 | 1/1912 | Fabry | 232/12 |
| 1,071,966 | 9/1913 | Sorensen | 312/207 |
| 2,127,594 | 8/1938 | Grossman | 312/207 |
| 2,643,171 | 6/1953 | Sterba | 312/198 |
| 2,655,424 | 10/1953 | O'Connor | 211/4 |
| 3,257,154 | 6/1966 | Lewis | 312/198 |
| 3,330,573 | 7/1967 | Sieloff | 70/58 |
| 3,468,430 | 9/1969 | Lawman | 211/191 |
| 3,512,857 | 5/1970 | Butera | 312/198 |
| 4,057,983 | 11/1977 | Morgan | 70/58 |
| 4,222,490 | 9/1980 | Wood | 211/60 |

FOREIGN PATENT DOCUMENTS

| | | | |
|---|---|---|---|
| 279938 | 11/1914 | Fed. Rep. of Germany | 211/4 |
| 342834 | 10/1921 | Fed. Rep. of Germany | 312/198 |
| 2706330 | 8/1978 | Fed. Rep. of Germany . | |
| 2727871 | 1/1979 | Fed. Rep. of Germany . | |
| 1391209 | 2/1964 | France . | |
| 2278293 | 7/1974 | France . | |
| 2424041 | 4/1978 | France | 211/60 SK |
| 2484950 | 12/1981 | France . | |

*Primary Examiner*—Kenneth J. Dorner
*Assistant Examiner*—Thomas A. Rendos
*Attorney, Agent, or Firm*—Sandler & Greenblum

[57] ABSTRACT

A security housing for storing and preventing the theft of elongated objects such as a windsurfer and its accessories is provided. The housing includes at least one compartment that is partially open at the top so that a portion of the windsurfer passes therethrough. The compartment has two vertical walls in intersecting planes, and a door and a lock that are controlled by a coin-operated apparatus.

The windsurfer and its accessories are prevented from being removed by: a top wall having an oblong opening whose length is less than the width of an accessory, such as a wishbone; a ring attached to one vertical wall that holds an accessory, such as a wishbone, in the compartment; and a tie that is extended transversely across the keel shaft of the windsurfer to hold the windsurfer in the compartment.

The compartment may be in the shape of a trapezoid or a triangle in cross-section. A plurality of compartments may be attached adjacent to one another in either a linear or circular configuration. In its linear configuration, adjacent compartments are inverted with respect to one another so that the front of one compartment is on the opposite side of the housing from adjacent compartments.

16 Claims, 7 Drawing Figures

SECURITY ENCLOSURE HAVING ONE OR MORE COMPARTMENTS FOR HOUSING AND PROTECTING A WINDSURFER AGAINST THEFT

BACKGROUND OF THE INVENTION

1. Field of the Invention

This invention relates to the field of windsurfer housings.

2. Background Art

In recent years, windsurfing has become popular. This sport requires the use of a windsurfer and its accessories: a mast, a wishbone, a sail and a keel. Wind surfers and their accessories are bulky apparatus but relatively light. Because they are bulky, windsurfers and their accessories are difficult to store. This is especially true in rented vacation residences and apartments, where no provision is usually made for storing such items. Because windsurfers and their accessories are relatively light, they are easy to steal.

In fact, theft of windsurfers and their accessories has increased as the sport has become more popular. Presently, there does not exist a practical means to guard windsurfers against theft. One currently effective method is to provide superintendents on the premises where windsurfing takes place to watch the windsurfers and their accessories. However, this method is costly.

A second means to guard against theft involves linking the mast and the wishbone transversely to the board in such a way as to render the windsurfer difficult to navigate. However, this is only a temporary expedient which is not practical when the windsurfer must be stored for a long period of time. Moreover, this expedient still requires human surveillance.

Thus there is a need for an apparatus that permits windsurfers and their accessories to be stored for long periods of time, safely, without fear of theft.

SUMMARY OF THE INVENTION

It is an object of the present invention to provide a housing for a windsurfer and its accessories so that the windsurfer and its accessories can be stored for long periods of time, safely, without fear of theft.

These objects are achieved by a security housing for storing elongated objects, such as a windsurfer and its accessories, such as a wishbone, comprising at least one compartment having a door, a locking means for locking the door, and a top face having a first opening therein. The compartment is adapted to receive at least one elongated object of greater length than the height of the compartment. Thus, a portion of the object passes through the first opening when the object stands vertically in the compartment. The housing also includes a removal prevention means for preventing the object from being removed from the compartment.

The housing further includes a coin-activated apparatus for controlling the locking means, whereby the locking and unlocking of the door is controlled by the coin-activated apparatus.

The compartment further comprises two vertical walls which lie in intersecting planes, or which intersect one another. The compartment may be in the shape of a triangle in cross-section, having three faces. The two vertical walls comprise two of the faces of the triangle, and the third face is the front opening of the compartment. In another embodiment, the compartment may be in the shape of a trapezoid in cross-section, having first and second opposed parallel faces. The first face is longer than the second opposed face, and the third and fourth faces are in intersecting planes, comprising the two vertical walls, respectively. The first face is the front opening of the compartment.

In another embodiment, the housing comprises a plurality of compartments. Each compartment has a front face which the door engages, and a rear face on the opposite side of the compartment from the front face. The compartments are positioned adjacent one another in a straight line, such that the front of each compartment is adjacent to the rear of an adjacent compartment.

In another embodiment, the housing comprises a plurality of compartments, wherein each compartment has at least one face transverse to the vertical walls, wherein the compartments are positioned adjacent one another, so that the faces of each compartment are approximately equidistant from a common point. Thus, the compartments are disposed in a circular configuration around the common point.

In one embodiment, the shape of the compartment in cross-section is an isosceles trapezoid, and, in another embodiment, the shape of the compartment in cross-section is a right triangle.

The housing further includes a top wall attached to one of the vertical walls, extending transversely to the walls, having a transverse width less than the distance between the vertical walls to define, between the top wall and the other of said walls, a first opening. The first opening is adapted to permit at least a portion of a windsurfer to pass therethrough. The top wall includes therein two oblong openings, at least one of which has a length that is less than the width of a wishbone at its widest point. Thus, the wishbone can become wedged in the oblong opening when the wishbone is pulled through the oblong opening.

The removal prevention means may comprise a ring attached to one of the vertical walls, and disposed under one of the oblong openings. The ring is adapted to receive a wishbone therein to prevent the wishbone from being removed from the compartment.

The removal prevention means, in another embodiment, is attached at one end to one of the vertical walls, and is disposed under the first opening. The removal prevention means in this embodiment is adapted to extend transversely across the keel shaft of the windsurfer to firmly attach the windsurfer to the compartment, thereby preventing the windsurfer from being removed from the compartment. In this embodiment, the removal prevention means comprises a flexible tie, attached transversely to the longitudinal axis of the vertical walls. The tie has a contact at one end thereof. The removal prevention means also includes a tread having a slot therein wherein the contact is adapted to engage the slot when the tie extends transversely across the windsurfer, to firmly attach the windsurfer to the compartment, thereby preventing the windsurfer from being removed from the compartment. The housing may further comprise a post to which the tread is attached. In this embodiment, the slot in the tread faces the door, whereby, when the door is closed, the door blocks the slot, thereby preventing the tie from disengaging from the slot.

The compartment may further include a slotted base adapted to permit water to flow therethrough.

The compartment may further include a coin-activated apparatus for locking and unlocking the locking means. In addition, the compartment may also include a lower frame for supporting the compartment, which comprises a plurality of hollow beams. Also included are a plurality of hollow posts, mounted on the frame, such that each of the vertical walls is mounted between and supported by the hollow posts. At least one post includes an opening in the front therein for receiving the coin-activated apparatus. The post having such an opening acts as a passageway for pieces of change travelling away from the coin-activated apparatus. The post with the opening in the front thereof also has a bottom opening in the bottom thereof. At least one of the hollow beams has an opening therein that communicates with the bottom opening of the post, whereby the beam with the opening acts as a collector for collecting pieces of change travelling from the post having an opening in the front thereof.

In another embodiment, the security housing for storing elongated objects, such as a windsurfer and its accessories, comprises a plurality of compartments. Each compartment includes two vertical side walls which lie in intersecting planes. Each compartment also includes a door, adapted to be closed between the two vertical side walls, and a locking means for locking the door. Each compartment also contains an opening in the top thereof, adapted to receive at least one elongated object of greater length than the height of the compartment, whereby the top of the object passes through the top opening. Each compartment also includes a removal prevention means for preventing the object from being removed through the opening in the top.

The removal prevention means may include an opening in a top wall attached to one of the vertical walls, extending transversely to the vertical walls. The length of an opening provided in the top wall is smaller than the width at its widest point of the object that passes therethrough, whereby the object becomes wedged in the top wall when the object is pulled at its top in the vertical direction away from the compartment.

Other advantages and characteristics of the invention will become apparent from a reading of the detailed description of the preferred embodiments that follows, given by way of a non-limiting example, in conjunction with the following drawings.

DETAILED DESCRIPTION OF THE PREFERRED EMBODIMENTS

Figure 1:
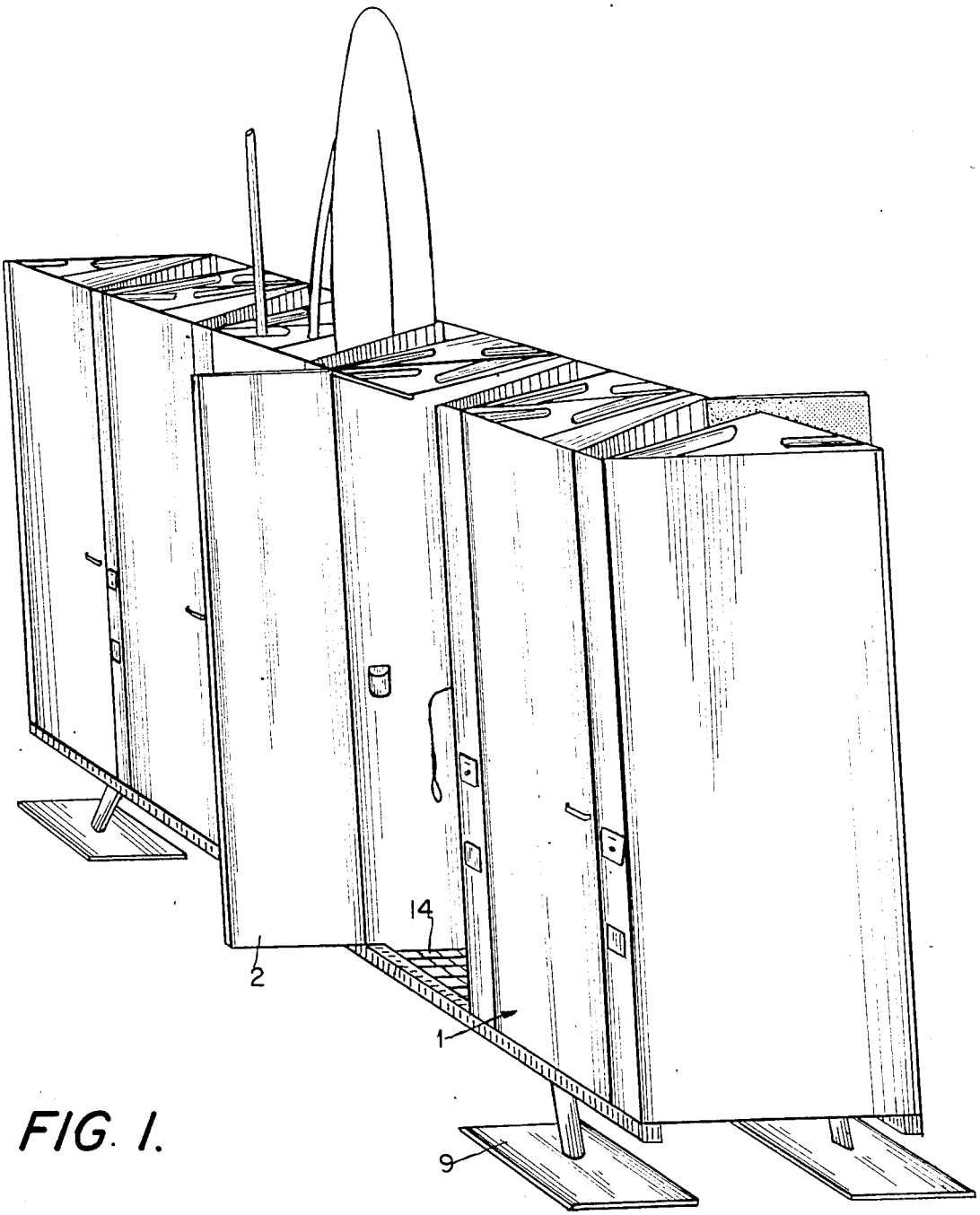
FIG. 1 illustrates a perspective view of one embodiment of the housing.

As seen in FIG. 1, the security housing according to the invention, includes one or more vertical compartments 1, adapted to receive an elongated object, such as a wind surfer and its accessories (a mast, wishbone, keel and sails), so as to store them for long periods of time and protect them from theft, as will be described hereinbelow.

Each of the compartments includes a means for preventing the removal of the windsurfer and its accessories from compartment 1, so as to protect them against theft, as will be discussed hereinbelow.

Each compartment 1 has a top face having an opening 17 therein. Opening 17 is transverse to the longitudinal axis of compartment 1 to allow the windsurfer, the mast, and the wishbone to pass therethrough when they are longer than the height of compartment 1, and are placed vertically therein. Preferably, the height of each compartment 1 is approximately $\frac{1}{2}$ or $\frac{2}{3}$ the length of the windsurfer.

Each compartment 1 contains a door 2 having a lock that is preferably controlled by a coin-activated apparatus familiar to those skilled in the art, whereby the locking and unlocking of door 2 is controlled by the coin-activated apparatus. Each housing preferably comprises a plurality of vertical compartments 1.

Figure 2:
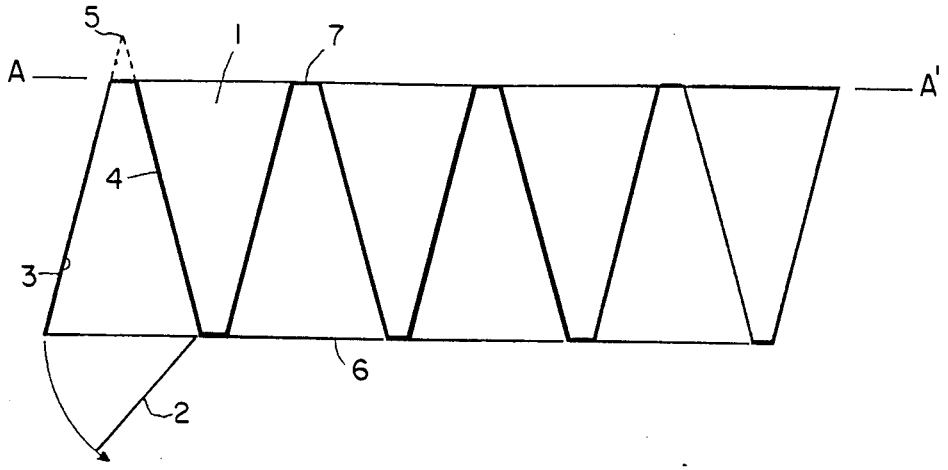
FIG. 2 illustrates a schematic top view of one embodiment of the housing in FIG. 1.

In order to obtain the maximum number of compartments in the minimum amount of space, each compartment 1, as seen in FIG. 2, is defined by at least two lateral vertical inner walls 3 and 4 which either intersect one another or are in planes intersecting one another shown at 5; the angle between walls 3 and 4 is preferably acute. Thus, the crosssection of each compartment is in the form of a triangle or a trapezoid. Vertical walls 3 and 4 comprise two opposed faces of the triangle or trapezoid. In the triangular configuration, the third face of the triangle is the front opening of compartment 1, which door 2 engages.

In the trapezoidal configuration, because the walls of each compartment are not parallel, the two parallel opposed faces 6 and 7, transverse to vertical walls 3 and 4, are of different lengths. The larger face 6 is chosen to be the front opening, which door 2 engages, and the smaller face 7 is chosen to be the rear face of compartment 1.

In one preferred embodiment, as seen in FIG. 2, each compartment 1 is in the shape of an isosceles trapezoid. Compartments 1 are positioned adjacent one another so that adjacent front and rear faces 6 and 7 are along the same line A—A', and the front of one compartment is adjacent to the rear of adjacent compartments. Thus, the front of one compartment is on the opposite side of the housing from the front of an adjacent compartment, or, in other words, the compartments are inverted with respect to each other. By joining adjacent compartments together along line A—A', a linear housing is formed. Alternatively, such a configuration of compartments can be achieved using compartments having a cross-section in the shape of an isosceles triangle.

Thus, the shape of the compartments and the manner in which they are positioned allows the maximum number of compartments to be formed for a given length of housing. Furthermore, this arrangement allows access to compartments on either side of the housing.

Other shapes for the compartment are also possible. For example, each compartment could have the shape of an isosceles right triangle. In addition, the housing need not be linear along a line such as A—A'.

Figure 3:
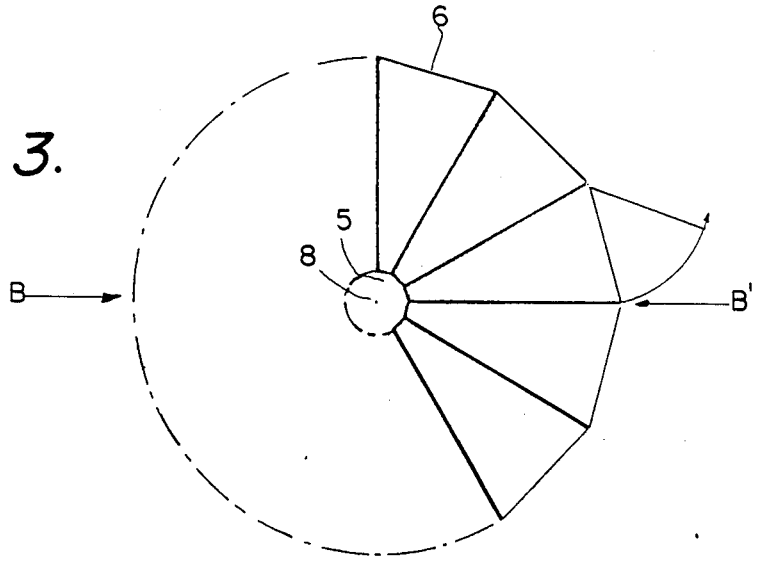
FIG. 3 illustrates a schematic top view of another embodiment of the invention.

Such an embodiment of the invention is illustrated by the schematic top view illustrated in FIG. 3. The housing comprises a plurality of compartments 1, each of which preferably has the shape of an isosceles trapezoid whose rear faces 5 are directed towards the same central point 8, or the rear faces of each compartment 1 are approximately equidistant from common central point 8. In addition, compartments 1 are adjacent to one another. Thus, the housing is of circular or partially circular configuration, wherein rear faces are all adjacent one another and form the circumference of a small circle around point 8, and front faces 6 are adjacent one another and form the circumference of a larger circle around point 8, whose diameter can be along line B—B'.

Figure 4:
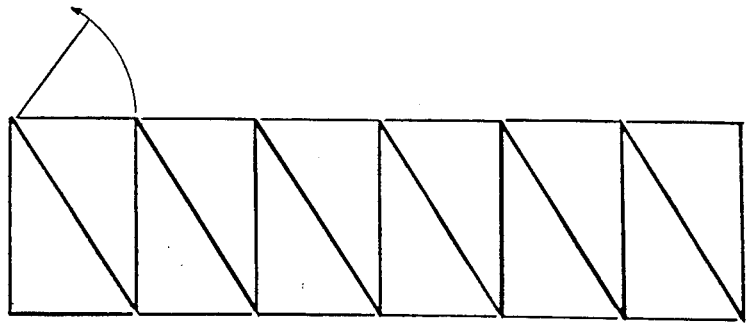
FIG. 4 is a schematic top view of still another embodiment of the invention.

According to still another embodiment, illustrated in the top view of FIG. 4, the housing is linear and includes a plurality of triangular compartments 1 in the shape of a right triangle positioned so that front face 6 of each compartment is next to rear face 5 of adjacent compartments, as described in discussing FIG. 2. Inner walls 3 and 4 of unequal length form a right triangle, so that when two right triangular compartments are inverted and placed adjacent one another with their front faces facing opposite directions, the combination forms a rectangle, as seen in FIG. 4. and FIG. 1. As seen in FIG. 1, compartments 1 are raised from the ground and rest on foot 9.

Figure 5:
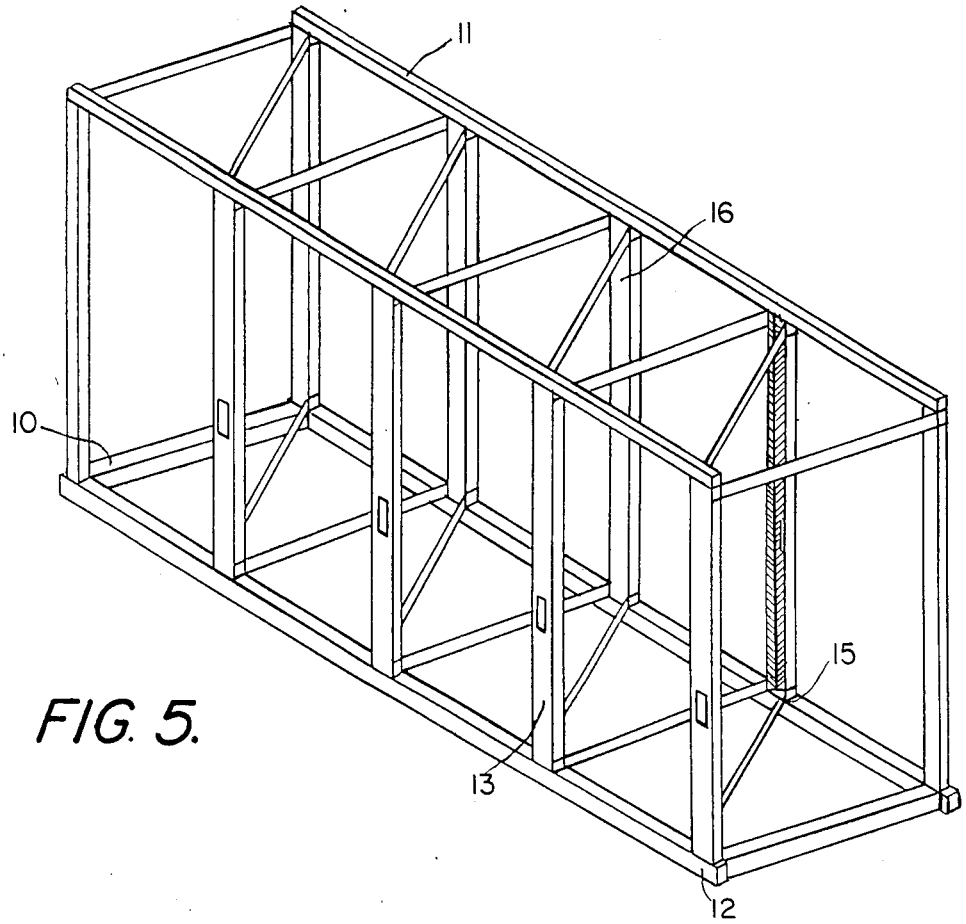
FIG. 5 is a perspective view of the frame of the housing of the invention.

FIG. 5 illustrates a perspective view of the frame of the housing. The frame comprises a lower frame 10 and an upper frame 11, which are composed of parallel hollow metallic beams, joined by crossbars at their ends transverse to the parallel beams. Frames 10 and 11 are connected by hollow vertical posts 13 attached to each beam 12.

Figure 6:
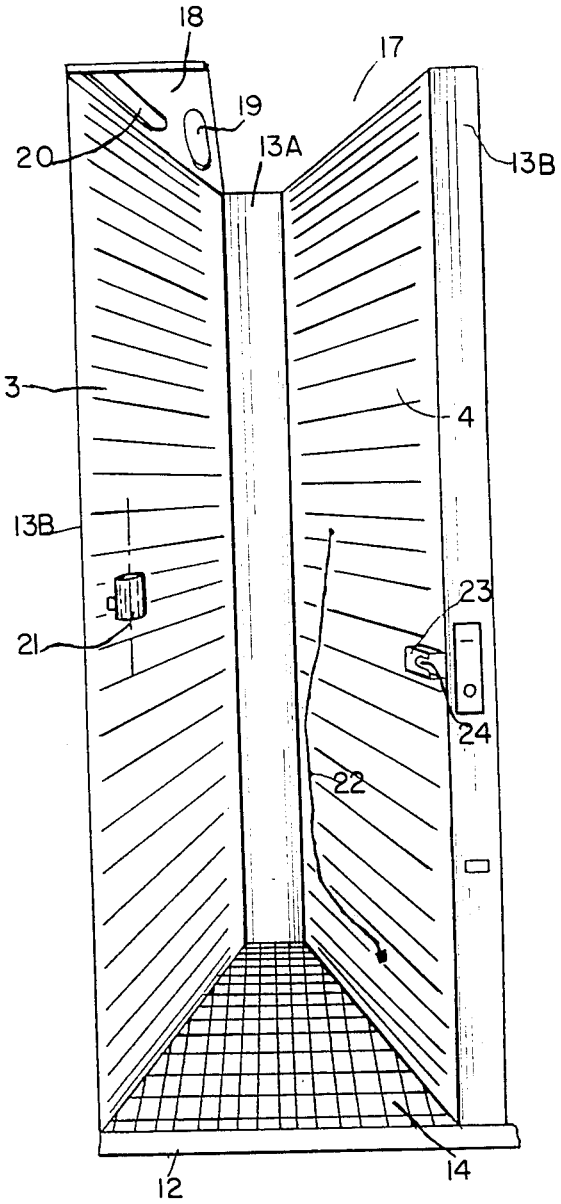
FIG. 6 is a front perspective view of the interior of a compartment of the invention.

As seen in FIG. 6, vertical posts 13 comprise posts 13A carried by the rear beam, and posts 13B carried by the front beam. Posts 13 are arranged such that posts 13A carried by the rear beam are interspersed between posts 13B carried by the front beam, and vice versa.

Lower frame 10 is provided with a base 14, as also seen in FIG. 6, which is slotted to allow the passage of water therethrough. Base 14 preferably comprises a strong metal grill welded to lower frame 10. Inner walls 3 and 4 are welded or attached by any other suitable means between post 13A and 13B in the following manner: inner wall 3 is attached to post 13A and to a front post 13B, and inner wall 4 is attached to the same rear post 13A and to another front post 13B. This process is repeated for each inner wall 3 and 4. Thus, inner walls 3 and 4 define a compartment, with an open top.

The housing defined by a plurality of inner walls 3 and 4 is braced in any manner familiar to those skilled in the art to produce a rigid structure.

Posts 13 are preferably composed of iron having a u-shaped cross-section open at the bottom thereof. Beams 12 preferably comprise hollow tubes having a rectangular opening 15 in the inner wall thereof. Posts 13 are preferably welded to beams 12, so that rectangular opening 15 communicates with the opening in the bottom of beam 13.

A portion of the front face of post 13, is cut out so as to form a window that opens into the hollow portion of post 13. The coin-activated apparatus that controls the lock on door 2, familiar to those skilled in the art, is mounted in the window. A steel plate 16 is welded to post 13, on the opposite side from the coin activated apparatus; plate 16 is long enough to contact beam 12 to its opening 15. U-shaped posts 13 and plates 16 together form evacuation ducts which provide a passageway for the pieces of change which travel by gravity from the coin activated apparatus to hollow beams 12, which act as a collector for the pieces of change. Plates 16 could be replaced by any suitable device; as long as such a device works in conjunction with posts 13 to form an evacuation duct.

Each hollow beam 12 can have mounted therein an apparatus for recovering the pieces of change received therein.

FIG. 6 illustrates the interior of compartment 1 and the means for attaching and holding the wind surfer and its accessories to compartment 1 so as to prevent their removal therefrom. FIG. 6 shows rear post 13A, a portion of a first front post 13B, a second post 13B (seen on the right in FIG. 6) that receives the door 2, and the inner walls 3, 4 and post 12.

The top of compartment 1 is partially open at 17 to permit the passage of the portion of a windsurfer that is of greater length than the height of the compartment. Blocking part of the top of compartment 1 is inner top wall 18. Inner top wall 18 is triangularly shaped and is welded near or at the top of inner wall 3 so that it extends transversely across compartment 1 and perpendicularly to wall 3. Thus, inner top wall 18 occupies a triangular transverse portion of the top of compartment 1, leaving portion 17 open. Inner top wall 18 occupies approximately half of the transverse triangular top portion of the compartment, and extends from the rear of compartment 1 (post 13A) to the front of compartment 1 (post 13B).

Inner top wall 18 contains two oblong openings 19 and 20 adapted to permit the passage of elongated elements, such as windsurfer accessories, to pass therethrough. The length of at least one of openings 19, 20 is less than the width of a wishbone at its widest point.

Openings 19 and 20 are disposed on either side of the longitudinal median axis of inner top wall 18. Opening 19 is positioned towards the front of compartment 1 on the exterior side thereof. Opening 20 is positioned towards the front of compartment 1 on the interior side thereof. The width of the openings 19, 20 is greater than the thickness of the elements and accessories of the windsurfer that will be inserted therein.

The length of openings 19 and 20 is less than the width of the wishbone at its widest point, so that when the windsurfer is inserted into one of the openings, the windsurfer cannot be pulled out through the top of compartment 1. If the portion of the windsurfer that passes through openings 19 or 20 is pulled, the wishbone becomes wedged in the opening and cannot be removed by pulling it through the opening. Thus, the wishbone is prevented from being removed from compartment 1 without the intervention of any complicated mechanical apparatus. Preferably, the wishbone is housed in opening 19.

The wishbone is also prevented from being removed from compartment 1 in another way: by ring or bracelet 21. Ring 21 is attached to wall 3, at a height approximately one-half the height of wall 3. In addition, ring 21 is positioned under opening 20, and does not protrude far enough away from wall 3 to contact the windsurfer board that stands in compartment 1 under opening 17, and passes therethrough. Ring 21 comprises two pieces that are joined at one point, so that ring 21 may swing open to permit the wishbone to pass therethrough, and can be rapidly closed by pressing the two pieces together, thereby holding the wishbone therein and preventing it from being removed from compartment 1.

The windsurfer board is attached to compartment 1 so as to prevent it from being removed therefrom by an attaching means that is mounted on the inner vertical wall that does not have top wall 18 mounted thereon, in this embodiment inner wall 4.

The attaching means comprises a flexible tie 22 attached transversely to inner wall 4 by any familiar means. This flexible tie 22 is preferably a steel cable sheath surrounding synthetic material, whose free end has welded contacts thereon.

On the internal side of post 13B in the middle thereof is welded a horizontal tread 23 having a slot 24 which faces door 2 of compartment 1. The width of slot 24 corresponds to the thickness of the tie 22 and is less than that of the contact at the end of the tie, so that when the contact and tie 22 are introduced in slot 24, tie 22 and its contact are securely engaged therein and cannot be pulled out.

According to a preferred embodiment of the invention, tread 23 is welded to the exterior border of post 13 at a height such that when door 2 is closed, the inner wall or door 2 blocks opening 24, thereby also securely holding tie 22 in slot 24.

To place the windsurfer in compartment 1, the door is opened, and the windsurfer is oriented vertically. The windsurfer is then placed in compartment 1 so that tie 22 extends transversely across the keel shaft of the windsurfer. Tie 22 is then placed in slot 24 of tread 23. When the door is closed, the inner wall of the door contacts tread 23, blocking slot 24, and thereby locking tie 22 therein, so that the board is securely fastened in compartment 1 and cannot be pulled out.

It is obvious that other means of attaching the windsurfer to compartment 1 so as to prevent its removal therefrom can be used. For example, a transverse inner wall mounted over opening 17, with an oblong opening having a length less than the width of the windsurfer at its widest point, can be used. Or, a rigid element transversely attached to an inner vertical wall and adapted to extend transversely across the keel shaft of the windsurfer may be used. In one embodiment, the end of this rigid element is received in a second element, such as a padlock.

Figure 7:
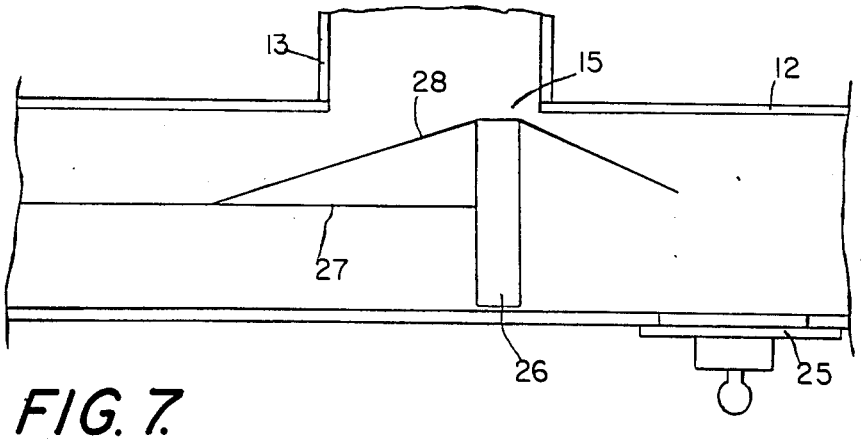
FIG. 7 is a partially cut-away side view of the portion of the invention that recovers change from the coin collector.

FIG. 7 shows in detail the beams 12 of lower frame 10. Each beam 12 comprises an opening in its lower inner wall. Engaging the opening is a door 25 equipped with a lock. Preferably, each beam 12 comprises two such openings positioned at each end of the beam, and two doors, one engaging each opening.

A horizontal scraper 26 having a maneuvering rod 27, is movably mounted in each beam. Scraper 26 has a deflector 28 attached to the upper part thereof. Deflector 28 comprises a band of steel forming a sheath that is at the top of scraper 26 and prevents scraper 26 from becoming wedged in the openings in base 14 and from becoming wedged in the pieces of change falling through post 13 into beam 12.

Preferably, the entire housing is treated to be protected against corrosion, and the housing may comprise one or a plurality of compartments, as has been discussed hereinabove.

Having thus described in detail the preferred embodiments of the invention, persons skilled in the art will be able to modify certain of the structure which has been described, and to substitute equivalent elements for those disclosed, while continuing to practice the principles of the invention. The scope of the invention is only limited by the appended claims.

What is claimed is:

1. A security housing for storing elongated objects, such as a windsurfer which includes a wishbone, said housing comprising at least one compartment comprising:

(a) a door;

(b) means for locking said door;

(c) a top face having a first opening therein;

(d) two vertical walls which lie in intersecting planes, wherein said compartment is adapted to receive said wishbone having a length greater than the vertical height of said compartment, wherein the length of said opening as measured along the longitudinal axis of said opening is less than the largest width of said wishbone as measured along said longitudinal axis of said opening when said wishbone is properly positioned in said compartment so that a portion of said wishbone extends through said first opening;

(e) means for preventing said wishbone from being removed from said compartment, said wishbone removal prevention means including said opening;

(f) a coin-activated apparatus for locking and unlocking said locking means;

(g) a lower frame for supporting said compartment, including a plurality of hollow beams; and (h) a plurality of hollow posts, mounted on said frame such that each of said vertical walls is mounted between and supported by said hollow posts, wherein at least one post includes an opening in the front therein for receiving said coin-activated apparatus, wherein said post having said opening includes means for passing pieces of change away from said coin-activated apparatus.

2. The housing of claim 1, further including a coin-activated apparatus for controlling said locking means, whereby the locking and unlocking of said door is controlled by said coin-activated apparatus.

3. The housing of claim 1 wherein said vertical walls intersect one another.

4. The housing of claim 3 wherein said compartment has the shape of a triangle in crosssection, having three faces, wherein said two vertical walls comprise two of said faces, and said third face is the front opening of said compartment.

5. The housing of claim 4 wherein said triangle is a right triangle.

6. The housing of claim 1 wherein said compartment has the shape of a trapezoid in crosssection, having first and second opposed parallel faces, wherein said first face is longer than said second face, and having third and fourth faces in intersecting planes comprising said two vertical walls, respectively, wherein said first face is the front opening of said compartment.

7. The housing of claim 6 wherein said trapezoid is an isosceles trapezoid.

8. The housing of claim 1 wherein said housing comprises a plurality of said compartments, wherein each compartment has a front face which said door engages, and a rear face on the opposite side of said compartment from said front face, wherein said compartments are positioned adjacent one another in a straight line, such that said front of each compartment is adjacent to said rear of an adjacent compartment.

9. The housing of claim 1 wherein said housing comprises a plurality of said compartments, wherein each compartment has at least one face transverse to said vertical walls, wherein said compartments are positioned adjacent one another so that said faces of each compartment are approximately equidistant from a common point, whereby said compartments are disposed in a circular configuration around said common point.

10. The housing of claim 1, further including a top wall attached to one of said vertical walls, extending transversely to said walls, having a transverse width less than the distance between said vertical walls to define, between said top wall and the other of said walls, a second opening, wherein said second opening is adapted to permit at least a portion of a windsurfer to pass therethrough, and wherein said top wall includes therein two oblong openings wherein one of said oblong openings comprises said first opening, whereby said wishbone becomes wedged in said first oblong opening when said wishbone is pulled through said first oblong opening.

11. The housing of claim 10 wherein said removal prevention means comprises a ring attached to one of said vertical walls and disposed under one of said oblong openings, and comprises means for receiving a wishbone therein and preventing said wishbone from being removed from said compartment.

12. The housing of claim 1 wherein said windsurfer comprises an entire keel shaft, wherein said housing further comprises means for preventing removal of said keel shaft, wherein said means for preventing removal of said keel shaft is attached at one end to one of said vertical walls, and disposed under said second opening, wherein said removal prevention means of said keel shaft is adapted to extend transversely across said keel shaft of said windsurfer to firmly attach said windsurfer to said compartment, thereby preventing said windsurfer from being removed from said compartment.

13. The housing of claim 12 wherein said removal prevention means of said keel shaft comprises:

(a) a flexible tie attached transversely to the longitudinal axis of said vertical walls, having a contact at one end thereof; and (b) a tread having a slot therein, wherein said contact is adapted to engage said slot when said tie extends transverely across said entire keel shaft of said windsurfer to firmly attached said windsurfer to said compartment, thereby preventing said windsurfer from being removed from said compartment.

14. The housing of claim 13 further comprising a post to which said tread is attached, wherein said slot faces said door, whereby, when said door is closed, said door blocks said slot, thereby preventing said tie from disengaging from said slot.

15. The housing of claim 1 wherein said compartment further comprises a slotted base adapted to permit water to flow therethrough.

16. The housing of claim 1 wherein said post with the opening in the front thereof also has a bottom opening in the bottom thereof, and at least one of said hollow beams has an opening therein that communicates with said bottom opening of said post, whereby said beam with said opening acts as a collector for collecting pieces of change travelling from said post having an opening in the front thereof.

* * * * *